US006578465B2

(12) United States Patent
Tagami

(10) Patent No.: US 6,578,465 B2
(45) Date of Patent: Jun. 17, 2003

(54) SWASH PLATE-TYPE, VARIABLE DISPLACEMENT COMPRESSOR

(75) Inventor: Shinji Tagami, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/986,356

(22) Filed: Nov. 8, 2001

(65) Prior Publication Data

US 2002/0073839 A1 Jun. 20, 2002

(30) Foreign Application Priority Data

Dec. 18, 2000 (JP) ..... P2000-383956

(51) Int. Cl.[7] ..... F04B 25/04; F04B 27/08
(52) U.S. Cl. ..... 92/12.2; 74/60
(58) Field of Search ..... 92/12.2; 91/505; 417/222.1, 269; 74/60

(56) References Cited

U.S. PATENT DOCUMENTS 4,506,648 A * 3/1985 Roberts ..... 417/222.1 X
4,664,604 A 5/1987 Terauchi
4,865,523 A 9/1989 Kikuchi et al.
4,872,815 A 10/1989 Takai
5,259,736 A 11/1993 Terauchi
5,282,725 A 2/1994 Shimizu
5,370,503 A 12/1994 Terauchi
5,425,303 A 6/1995 Shimizu et al. ..... 92/12.2
5,582,092 A * 12/1996 Nomura et al. ..... 92/12.2 X
5,839,347 A * 11/1998 Nomura et al. ..... 74/60
6,158,968 A 12/2000 Nakamura
6,179,572 B1 1/2001 Taguchi

FOREIGN PATENT DOCUMENTS

DE 1 933 783 * 1/1971 ..... 92/12.2

* cited by examiner

*Primary Examiner*—Edward K. Look
*Assistant Examiner*—Thomas E. Lazo
(74) *Attorney, Agent, or Firm*—Baker Botts L.L.P.

(57) ABSTRACT

A swash plate-type, variable compressor according to the present invention has a connection mechanism between a rotor and swash plate and includes a double pivot mechanism, and has a swash plate, the vertex of the oblique angles of which is shifted to the center of gravity side of the swash plate from the geometric center of the swash plate by a predetermined amount. By choosing an appropriate value for this offset distance, a characteristic curve of piston top clearance relative to change of oblique angle of the swash plate remains at a value of about zero over a relevant range of the oblique angle of the swash plate. As a result, volumetric efficiency of the compressor is effectively improved.

1 Claim, 4 Drawing Sheets

SWASH PLATE-TYPE, VARIABLE DISPLACEMENT COMPRESSOR

BACKGROUND OF THE INVENTION

1. Field of the Invention

The present invention relates to a swash plate-type, variable displacement compressor for use in a vehicle air conditioning apparatus. More particularly, this invention relates to a swash plate-type, variable displacement compressor that effectively reduces piston top clearance for a range of oblique angles of the swash plate, and thereby reduces the compressor's vibration, while improving volumetric efficiency.

2. Description of Related Art

In FIG. 1, a known swash plate-type, variable displacement compressor 100 used in a vehicle air conditioning apparatus is shown. The casing of compressor 100 comprises a front housing 101, a cylinder block 102, and a rear housing 103. A drive shaft 104 is provided to pass through the center of front housing 101 and cylinder block 102. Drive shaft 104 is rotatably supported by front housing 101 and cylinder block 102, via bearings 105, 106. In cylinder block 102, a plurality of cylinder bores 107 are arranged equiangularly around an axis 108 of drive shaft 104. In each of cylinder bores 107, a piston 109 is slidably disposed. Pistons 109 reciprocate along a direction parallel to drive shaft axis 108.

A rotor 110 is fixed to drive shaft 104, so that rotor 110 may rotate together with drive shaft 104. Rotor 110 has an arm 110*a*, through a terminal part of which is provided an oblong hole 110*h*. Front housing 101 and cylinder block 102 cooperatively define a crank chamber 111. A swash plate 112 having a penetration hole 112*c* at its center portion is accommodated within crank chamber 111, through which drive shaft 104 penetrates. Penetration hole 112*c* of swash plate 112 has a complex shape that enables changes of oblique angle of the swash plate 112 with respect to the axis 108. An arm 112*a* is provided on a front housing side surface of swash plate 112. A pin 112*p* projects at a terminal part of arm 112*a*. The terminal part of arm 112*a* draws a circular locus when arm 112*a* rotates around axis 108 (i.e., perpendicular to the plane of FIG. 1). Pin 112*p* projects in a direction tangential to that circular locus. Pin 112*p* is slidably fitted into oblong hole 110*h*. Because pin 112*p* moves within oblong hole 110*h*, the oblique angle of swash plate 112 with respect to axis 108 varies. Hereinafter, the connection mechanism comprising arm 110*a* of rotor 110, oblong hole 110*h* of arm 110*a*, pin 112*p*, and arm 112*a* of swash plate 112, is referred to as C1. The circumferential portion of swash plate 112 has the shape of a planar ring, and is connected slidably to a tail portion of each of pistons 109 via pairs of shoes 113.

When drive shaft 104 is driven by an external power source (not shown), rotor 110 rotates around axis 108 together with drive shaft 104. Swash plate 112 also is made to rotate by rotor 110, via the connection mechanism C1. Simultaneously with the rotation of swash plate 112, the circumferential portion of swash plate 112 exhibits a wobbling motion. A component of movement in the axial direction parallel to axis 108 of the wobbling circumferential portion of swash plate 112 is transferred to pistons 109 via sliding shoes 113. As a result, pistons 109 reciprocate within cylinder bores 107. Finally, in refrigeration circuit operation, a refrigerant may be repeatedly introduced from an external refrigeration circuit (not shown) into a compression chamber 115, which is defined by the piston top of piston 109, cylinder bore 107, and a valve plate 114, to compress the refrigerant by the reciprocation of each piston 109, and to then discharge the refrigerant to the external refrigeration circuit (not shown).

However, such known compressors may exhibit the following limitations. First, in compressor 100, the vertex of the oblique angle is designed to be located at a point 116 at the intersection of a center line 117 of swash plate 112 and axis 108, as shown in FIG. 1. Thus, the position of the vertex of the oblique angle of swash plate 112 depends on the shape of penetration hole 112*c* of swash plate 112. On the other hand, a center of gravity 118 of swash plate 112 is located at a point relatively far offset above axis 108, as shown in FIG. 1. Because center of gravity 118 of swash plate 112 is relatively far offset from axis 108 of rotation of drive shaft 104, compressor 100 is unbalanced. When drive shaft 104 rotates, this offset generates a vibration in compressor 100. Second, in actual manufacture, connection mechanism C1 may be difficult to make with a low tolerance (i.e., a reduced dimensional variance among the components) because of its complicated shape. As a result, it is difficult to suppress the occurrence of a high tolerance (i.e., increased dimensional variance among the components) between oblong hole 110*h* and pin 112*p*. The existence of a high tolerance adversely affects the durability of compressor 100. Third, there may be a problem of controlling piston top clearance. The piston top clearance is a distance between the piston top of piston 109 and valve plate 114 when piston 109 is in a top dead center position.

SUMMARY OF THE INVENTION

A need has arisen to reduce compressor vibration, while improving the volumetric efficiency of the compressor. The present invention provides a swash plate-type, compressor having a connection mechanism for the rotor and the swash plate that eliminates or reduces the size of tolerances between compressor components and thereby improves volumetric efficiency. According to the present invention, the compressor may have a connection mechanism between the rotor and the swash plate comprising a link arm having two pivots. This link arm mechanism provides in practice a connection mechanism of the rotor and the swash plate that has a low tolerance. Another need has arisen to locate the vertex of the oblique angle of the swash plate at an improved or optimum position, so that the variation of the piston top clearance as a function of the oblique angle of the swash plate is improved. By making the variation of the piston top clearance as a function of the oblique angle of the swash plate optimum, it is possible to suppress the dead volume and improve the volumetric efficiency of the compressor for the required range of the oblique angle of the swash plate.

In an embodiment of this invention, a swash plate-type compressor includes a front housing, a cylinder block, and a rear housing. A drive shaft is supported rotatably by the front housing and cylinder block. A rotor is fixed to, and rotatable with, the drive shaft. Cylinder bores are arranged around the axis of the drive shaft. Each cylinder bore houses a piston that reciprocates therein. A swash plate is mounted movably on the drive shaft. The pistons are connected to the swash plate by shoes. A connection mechanism links the rotor and swash plate such that the swash plate changes its oblique angle with respect to the drive shaft axis. The connection mechanism includes a first arm that projects from the rotor, a second arm that projects from the swash plate, and a link arm that connects the first and second arms. The first arm and a terminal end of the link arm are connected rotatably by a first pin. The second arm and the other terminal end of the link arm are connected rotatably by a second pin. The first pin extends in a direction tangential to a circular locus formed by a terminal part of the first arm as it rotates around the axis of the drive shaft. The second pin extends in a direction parallel to the first pin.

In another embodiment of this inventions a method is provided for adjusting the location of the vertex of an oblique angle of a swash plate-type compressor. First, a central portion of a swash plate is drilled to form an opening through the central portion of the swash plate. Then, the location of the vertex of the oblique angle is offset from the geometric center of the swash plate by an amount. The swash plate is rotated in a clockwise direction about the offset vertex. Then, a second opening is formed through a central portion of the swash plate.

Other objects, features, and advantages of this invention will be understood from the following description of preferred embodiments with reference to the accompanying drawings.

BRIEF DESCRIPTION OF DRAWINGS

The invention may be more completely understood by reference to the following figures.

DETAILED DESCRIPTION OF PREFERRED EMBODIMENTS

Figure 2:
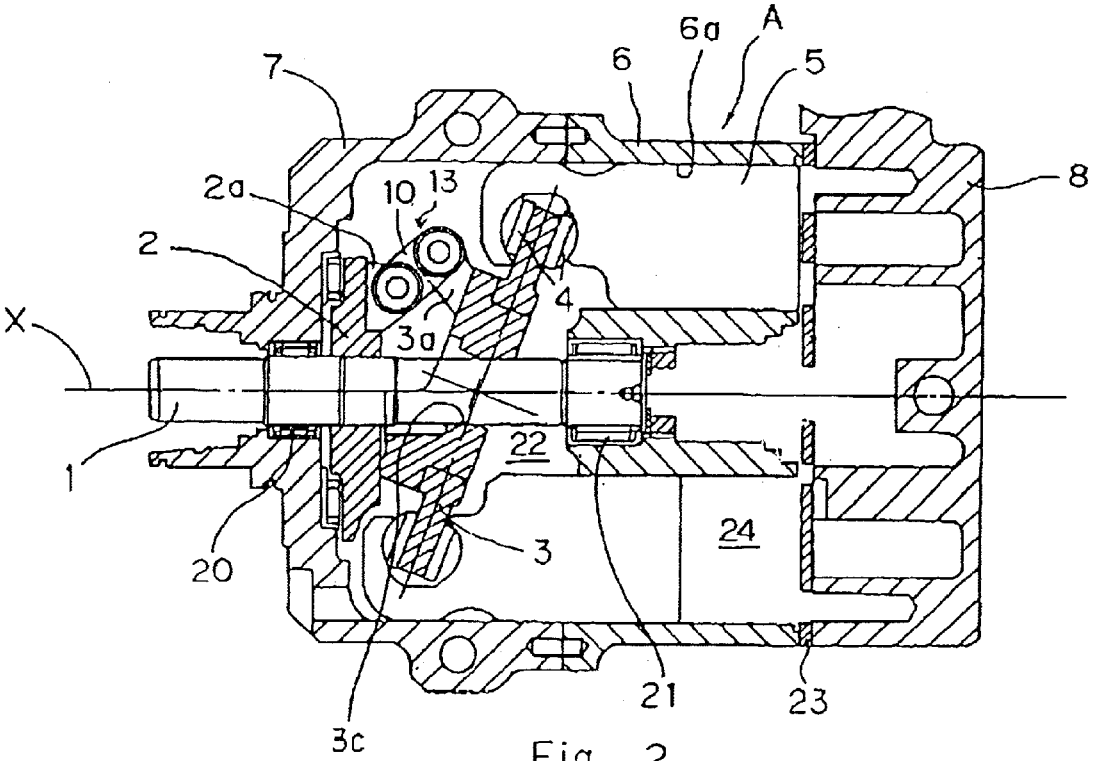
FIG. 2 is a cross-sectional view of a swash plate-type, variable displacement compressor according to the present invention.

In FIG. 2, a swash plate-type, variable displacement compressor A according to the present invention is shown. The casing of compressor A comprises a front housing 7, a cylinder block 6, and a rear housing 8. A drive shaft 1 passes through the center of front housing 7 and cylinder block 6. Drive shaft 1 is rotatably supported by front housing 7 and cylinder block 6, via bearings 20 and 21. In cylinder block 6, a plurality of cylinder bores 6*a* are arranged equiangularly in cylinder block 6 around an axis X of the drive shaft 1. In each of cylinder bores 6*a*, a piston 5 is slidably disposed. Pistons 5 reciprocate in a direction parallel to axis X.

A rotor 2 is fixed to the drive shaft 1 and rotates with the drive shaft 1. Rotor 2 has an arm 2*a*. Front housing 7 and cylinder block 6 cooperatively define a crank chamber 22. A swash plate 3 having a penetration hole 3*c* formed through its center portion is accommodated within crank chamber 22, through which drive shaft 1 penetrates. Penetration hole 3*c* of the swash plate 3 has a complex shape to enable the change of oblique angles of swash plate 3 with respect to axis X of drive shaft 1. By appropriately designing the shape of penetration hole 3*c*, the vertex of oblique angles of swash plate 3 may be set at a desired position. Rotor 2 and swash plate 3 are connected via a link arm connection mechanism 13, which comprises an arm 2*a* of rotor 2, a link arm 10, and an arm 3*a* provided on the front housing side surface of swash plate 3. The circumferential portion of swash plate 3 has a shape of a planar ring, and is connected slidably to the tail portions of each of pistons 5 via pairs of shoes 4.

When drive shaft 1 is driven by an external power source (not shown), rotor 2 also rotates around axis X together with drive shaft 1. Swash plate 3 also is made to rotate by rotor 2, via connection mechanism 13. Simultaneously with the rotation of swash plate 3, the circumferential portion of the swash plate 3 exhibits a wobbling motion. A portion of the movement of the wobbling circumferential portion of swash plate 3 in an axial direction parallel to axis X is transferred to each of pistons 5 via sliding shoes 4. As a result, pistons 5 reciprocate within cylinder bores 6*a*. Finally, in refrigeration circuit operation, refrigerant from an external refrigeration circuit (not shown) may be repeatedly introduced into compression chamber 24, which is defined by the piston top of piston 5, cylinder bore 6*a*, and valve plate 23, to compress the refrigerant by reciprocating piston 5, and then to discharge the refrigerant to the external refrigeration circuit.

Figure 3:
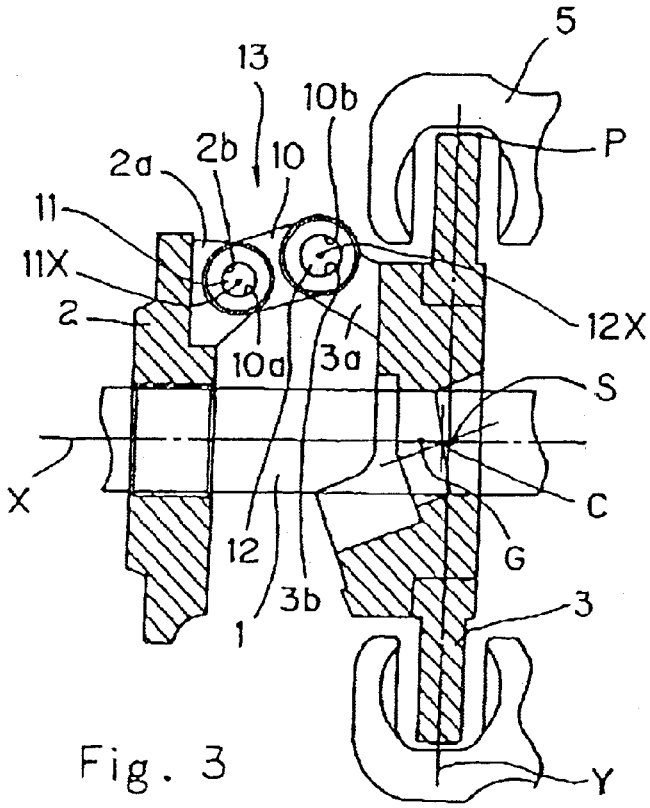
FIG. 3 is a cross-sectional view of the link arm connection mechanism of the compressor of FIG. 2 at a minimum oblique angle state.

In FIG. 3, an enlarged illustration of connection mechanism 13 of rotor 2 and swash plate 3 of FIG. 2 is shown. A hole 2*b* is formed through arm 2*a* of rotor 2. A hole 3*b* is formed through arm 3*a* of swash plate 3. Holes 10*a* and 10*b* are formed therethrough at both ends of link arm 10. A pin 11 is inserted into hole 2*b* and hole 10*a*. Another pin 12 is inserted into hole 3*b* and hole 10*b*. When arm 2*a* of rotor 2 rotates around axis X (i.e., perpendicular to the plane of FIG. 3), hole 2*b* draws a circular locus. An axis 11X of pin 11 projects in a direction tangential to that circular locus. By fixing pin 11 into hole 2*b* and hole 10*a*, link arm 10 rotates around axis 11X. An axis 12X of pin 12 is parallel to axis 11X (i.e., perpendicular to the plane of FIG. 3). By fixing pin 12 into hole 3*b* and hole 10*b*, swash plate 3 rotates around axis 12X. Thus, an oblique angle of swash plate 3 changes via the double pivot action of link arm connection mechanism 13. In practice, because a spring (not shown) is disposed between rotor 2 and swash plate 3 to urge swash plate 3 in a direction of rear housing 8, movement of swash plate 3 is biased in that direction. As a result, when the oblique angle of swash plate 3 changes, the range of movement of swash plate 3 may be uniquely determined.

Figure 4:
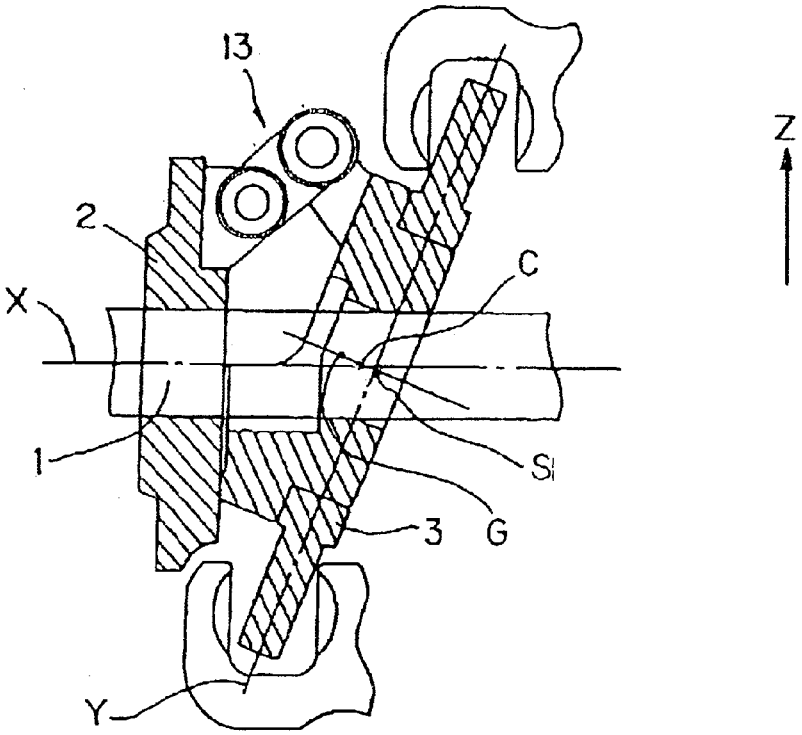
FIG. 4 is a cross-sectional view of the link arm connection mechanism of the compressor of FIG. 2 at a maximum oblique angle state.

In FIGS. 3 and 4, point S is the geometric center of swash plate 3, which also was the vertex of oblique angles of the swash plate for the known compressor. In FIGS. 3 and 4, the vertex of oblique angles of the swash plate 3 is set to another point C. As discussed below, an optimum or preferred offset distance exists between the geometric center S of swash plate 3 and the actual vertex C of oblique angles of swash plate 3, such that the volumetric efficiency of the compressor may be improved with connection mechanism 13.

For connection mechanism 13 of rotor 2 and swash plate 3, pins 11, 12, and holes 2*b*, 3*b*, 10*a*, and 10*b* may be manufactured with very low tolerance (i.e., with reduced dimensional variance among the components). Therefore, the size of tolerances between components within connection mechanism 13 may be eliminated or reduced. Consequently, the durability of such compressors is effectively improved.

In FIG. 3, the minimum oblique angle state of swash plate 3 is shown. In this state, because both the center of gravity G of swash plate 3 and the vertex C of the oblique angles of swash plate 3 are located on axis X, compressor A is not unbalanced. Thus, in this state, vibration associated with an offset between center of gravity G and vertex C is not generated.

In FIG. 4, the maximum oblique angle state of swash plate 3 is shown. In this state, because the center of gravity G of swash plate 3 is located above axis X, compressor A is unbalanced. The vertex C of oblique angles of swash plate 3 remains on axis X; however, the geometric center S of swash plate 3 moves below axis X, as shown in FIG. 4. The distance in the z direction between the center of gravity G of swash plate 3 and the vertex C of the oblique angles of swash plate 3 is less than the distance in the z direction between the center of gravity G of swash plate 3 and the geometric center S of swash plate 3. Thus, the distance in the z direction between the center of gravity G of swash plate 3 and axis X is less than in the known compressor, in which the geometric center S is located on axis X. Thus, for compressors according to the present invention, the degree of unbalance due to the distance of the center of gravity of swash plate 3 from axis X is reduced compared with known compressors. Therefore, even in a maximum oblique angle state of swash plate 3, the resultant vibration of the compressor is reduced.

Figure 5:
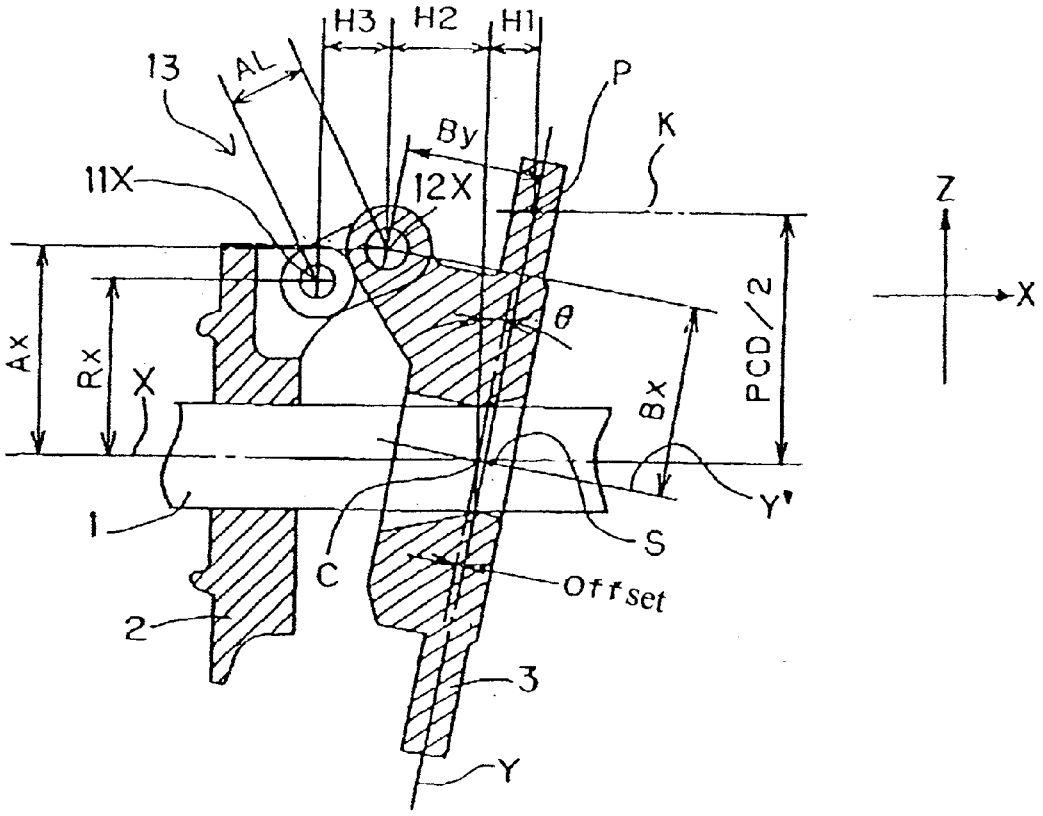
FIG. 5 is a cross-sectional view of the link arm connection mechanism showing various parameters.

With reference to FIG. 5, a point P lies at an intersection of central line Y of swash plate 3 and an axis K of piston 5. By computing the position of the point P in the X direction, the variation of the piston top clearance with respect to changes of oblique angles of swash plate 3 may be determined.

The parameters used in computing top clearance in this invention are as follows:

Rx: The distance between axis X and axis 11X of pin 11;

Ax: The distance between axis X and axis 12X of pin 12;

AL: The distance between axis 11X of pin 11 and axis 12X of pin 12;

H3: The distance in an X direction between axis 11X and axis 12X;

H2: The distance in an X direction between axis 12X and the vertex C of oblique angles of swash plate 3;

H1: The distance in an X direction between the vertex C of oblique angle of the awash plate 3 and point P;

By: The distance between axis 12X and center line Y;

Bx: The distance between axis 12X and a line Y' which passes through the geometric center S of swash plate 3 and is perpendicular to center line Y;

Offset: The distance in the Y' direction between vertex C of the oblique angle of the swash plate and the geometric center S of the swash plate 3;

PCD/2: The distance between axis K of the piston and axis X of drive shaft 1; and θ: The oblique angle of swash plate 3.

All of the above parameters are constants, except the variables θ, Ax, H1, H2, and H3. The position of point P in the X direction is given by a summation of H1 and H2 and H3 and an appropriate constant. Thus, $$\text{Piston top clearance}=H1+H2+H3+const \quad \text{Eq(1)}$$

where:

$$H1=(PCD/2)\tan\theta+\text{Offset}\cos\theta \quad \text{Eq(2)}$$

$$H2=(By-(Bx\tan\theta+\text{Offset}))\cos\theta \quad \text{Eq(3)}$$

$$H3=(AL^2-(Ax-Rx)^2)^{1/2} \quad \text{Eq(4)}$$

$$Ax=Bx\cos\theta+By\sin\theta-\text{Offset}\sin\theta \quad \text{Eq(5)}$$

Thus, the piston top clearance of the compressor according to the present invention is given by the above functions of θ (i.e., the oblique angle of swash plate 3).

The invention will be clarified further by consideration of the following example, which is intended to be purely exemplary of the use of the invention. The inventor has performed a number of calculations using parameters shown below.

PCD=79.5 mm

Bx=28.6 mm

By=23.5 mm

AL=12.5 mm

Rx=26.0 mm

Offset=0.0 mm, 2.0 mm, 1.0 mm

Figure 6:
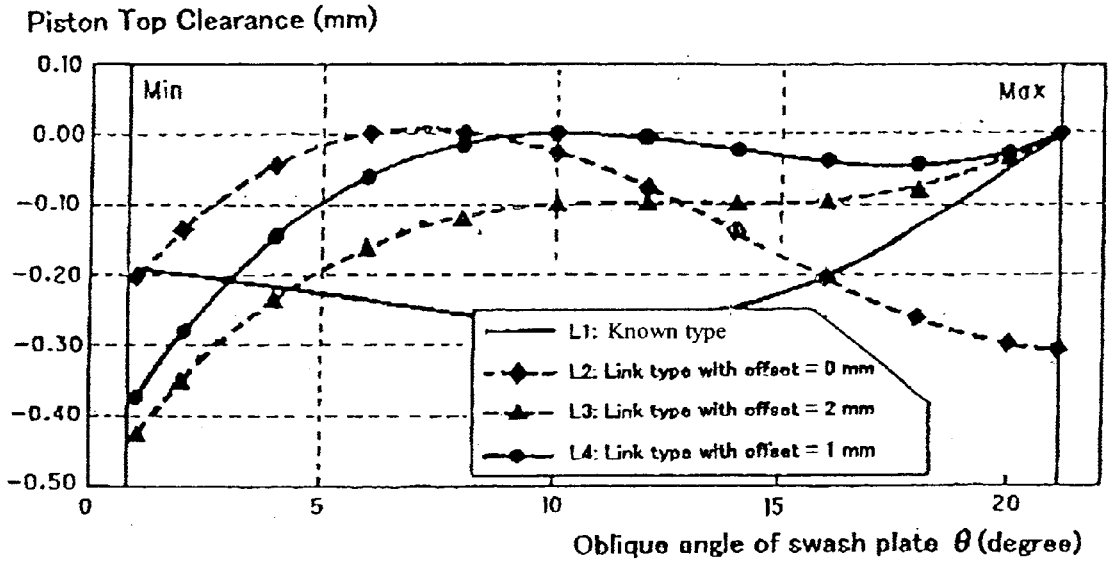
FIG. 6 is a graph showing the relationship of piston top clearance and the oblique angle of the swash plate of a known compressor and three (3) embodiments of the compressor according to the present invention.

The results of the calculations obtained using these parameters appear in FIG. 6. Line L1 shows the behavior of piston top clearance of a known compressor having the connection mechanism C1, as mentioned before. Lines L2, L3, and L4 describe the behavior of piston top clearance of the compressor according to embodiments of the present invention having connection mechanism 13. Line L2 corresponds to Offset=0 mm. Line L3 corresponds to Offset=2.0 mm. Line L4 corresponds to Offset=1.0 mm.

Figure 1:
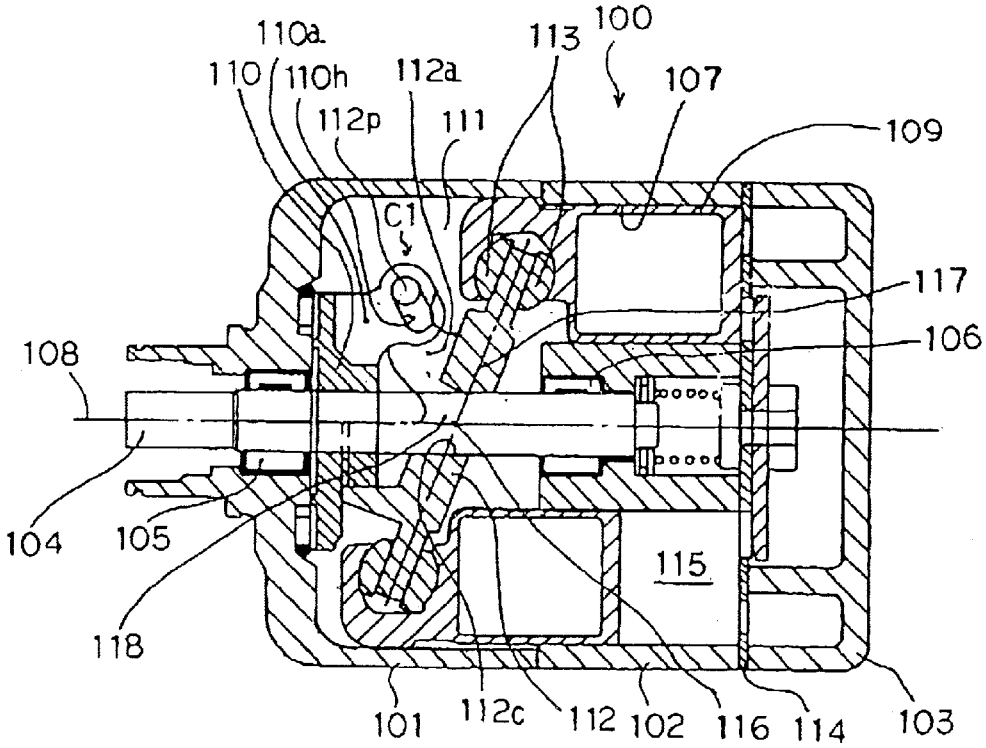
Fig . 1 (PRIOR ART)
FIG. 1 is a cross-sectional view of a known swash plate-type, variable displacement compressor.

With reference to FIG. 6, Line L1 shows a relationship between the oblique angle θ of swash plate 112 of FIG. 1 and a piston top clearance for a connection mechanism C1 of a known compressor. Ideally, it is desired that the piston top clearance of a compressor remains about zero over a range from about five (5) degrees to a maximum angle (about twenty-one (21) degrees) of the oblique angle of the swash plate. If there is a non-zero, piston top clearance for that range of the oblique angle of the swash plate, then there remains a corresponding dead volume for the compression chambers, and the volumetric efficiency of the compressor decreases accordingly. In FIG. 6, the larger the negative value of the piston top clearance (i.e., the further that piston top clearance is from 0.00 mm), the greater the dead volume of the compressor. Over a range of oblique angles from zero (0) degrees to about five (5) degrees, it is known in the compressor art that there should remain some degree of piston top clearance. From curve L1, over the range of oblique angles of the swash plate between about six (6) degrees and about twenty-one (21) degrees, the curve is substantially horizontal, and substantially offset from the Piston Top Clearance=0.00 line. Consequently, in the known compressor, a considerable dead volume over the important range of the oblique angle of the swash plate remains. Thus, for a known connection mechanism C1, the change of piston top clearance as a function of the oblique angle of the swash plate occurs in an undesirable manner.

As discussed above, the behavior of the piston top clearance that remains about at a zero value over a range of θ from about five (5) degrees to about twenty-one (21) degrees is desirable. Over a range of θ from about zero (0) degrees to about five (5) degrees, the piston top clearance has a residual, non-zero value. Among the lines L2, L3, and L4, line L4 (Offset=1.0 mm) best satisfies these conditions.

Figure 7A:
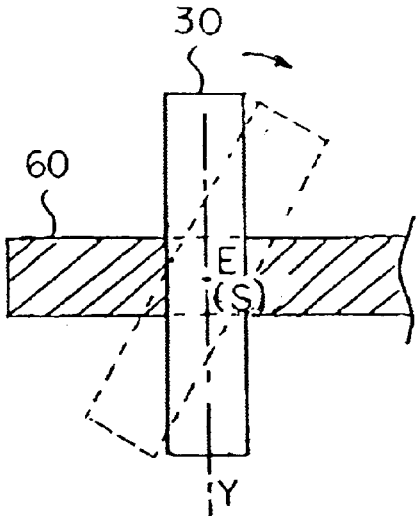
FIGS. 7*a*–7*d* provide a schematic illustration showing a manufacturing method for obtaining a swash plate that has a vertex of the oblique angle at a desired position.
Figure 7B:
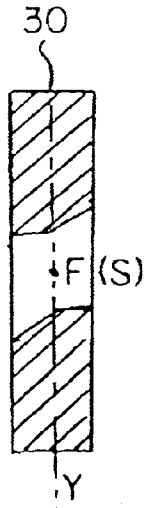

FIGS. 7*a*–7*d* illustrate schematically how the offset distance (Offset) may be determined between vertices F, F' of the oblique angle of swash plate 30 and the geometric center S of swash plate 30. With reference to FIG. 7*a,* the central portion of swash plate 30 is drilled vertically by an end mill 60. Swash plate 30 then is inclined with respect to a center point E located on the geometric center S of the swash plate 30, in a clockwise direction. As a result, as shown in FIG. 7*b,* the vertex F of the oblique angle is located at the same position as the geometric center S of swash plate 30.

Figure 7C:
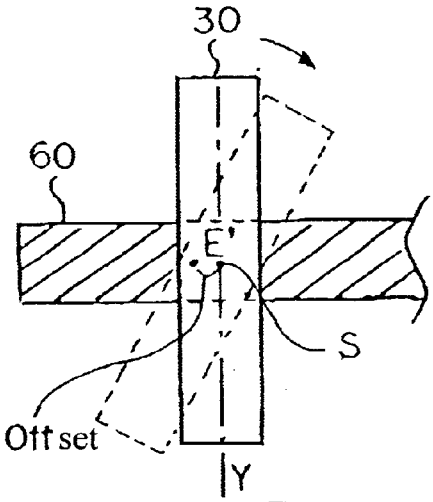
Figure 7D:
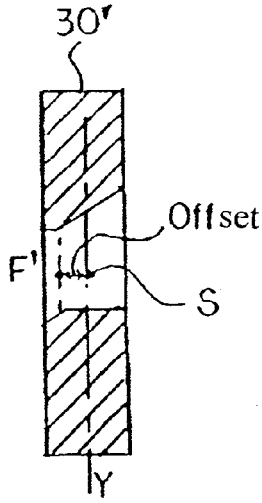

With reference to FIG. 7*c,* the central portion of swash plate 30 again is drilled vertically by end mill 60. Swash plate 30 then is inclined with respect to a center point E', which is located at a position displaced by an amount Offset from the geometric center S, in a clockwise direction. As a result, as shown in FIG. 7*d,* the vertex F' of the oblique angle is located at a position shifted from the geometric center S by an amount Offset. Therefore, by choosing appropriately the offset distance of the vertex of the oblique angle of the swash plate from the geometric center of the swash plate, the behavior of the piston top clearance may be controlled, so that the volumetric efficiency of the compressor over the range of oblique angles of the swash plate may be improved effectively. Thus, by employing the link arm connection and by choosing appropriately the offset distance of the vertex of the oblique angle of the swash plate from the geometric center of the swash plate, the compressor according to the present invention reduces or eliminates the vibration, enjoys increased durability and improved volumetric efficiency.

Although the present invention has been described in detail in connection with preferred embodiments, the invention is not limited thereto. It is intended that the specification and example be considered as exemplary only, with the true scope and spirit of the invention being indicated by the following claims. Further, it will be understood by those skilled in the art that other embodiments, variations and modifications of the invention will be apparent to those skilled in the art from a consideration of this specification or practice of the invention disclosed herein, and may be made within the scope of this invention, as defined by the following claims.

What is claimed is:

1. A swash plate-type compressor, comprising:

a front housing;

a cylinder block;

a rear housing;

a drive shaft rotatably supported by said front housing and said cylinder block;

a rotor fixed to said drive shaft to be rotatable with said drive shaft;

a plurality of pistons slidably disposed in cylinder bores formed in the cylinder block around an axis of said drive shaft;

a swash plate movably mounted to said drive shaft and to which are connected said pistons via shoes; and a connection mechanism between said rotor and said swash plate such that an oblique angle of said swash plate changes with respect to a line oriented perpendicular to the axis of said drive shaft, wherein, said connection mechanism comprises a first arm projecting from said rotor, a link arm, and a second arm projecting from said swash plate, wherein said first arm and a terminal end of said link arm are connected rotatably by a first pin, said terminal part of said first arm drawing a circular locus as said first arm rotates around said axis, and said first pin extending in a direction tangential to said circular locus, and wherein said second arm and the other terminal end of said link arm are connected rotatably by a second pin extending in a direction parallel to said first pin, wherein a position of a pair of vertexes of said swash plate is offset from a geometric center of said swash plate.

* * * * *